US006726582B1

(12) United States Patent
Kuo et al.

(10) Patent No.: US 6,726,582 B1
(45) Date of Patent: Apr. 27, 2004

(54) SPORT BALL HAVING IMPROVED SURFACE AND METHOD FOR MANUFACTURE THEREOF

(75) Inventors: Chang Chin Kuo, Taipin (TW); Shu Chi Chang, Longchong (TW); Pei-Jung Chou, Taipei (TW)

(73) Assignee: Classic Sport Companies, Inc., Denver, CO (US)

( * ) Notice: Subject to any disclaimer, the term of this patent is extended or adjusted under 35 U.S.C. 154(b) by 0 days.

(21) Appl. No.: 09/481,024

(22) Filed: Jan. 11, 2000

(51) Int. Cl.[7] ..... A63B 41/08
(52) U.S. Cl. ..... 473/604
(58) Field of Search ..... 473/594, 595, 473/596, 599, 603, 604, 600, 605

(56) References Cited

U.S. PATENT DOCUMENTS

| | | | | | |
|---|---|---|---|---|---|
| 3,475,206 | A | * | 10/1969 | Heyden | 442/89 |
| 3,696,034 | A | * | 10/1972 | Hewitt et al. | 427/242 |
| 3,863,923 | A | * | 2/1975 | Anderson | 473/604 |
| 4,606,544 | A | * | 8/1986 | Olazabal, Jr. | 473/605 |
| 4,755,187 | A | * | 7/1988 | Friese et al. | 8/94.23 |
| 4,877,617 | A | * | 10/1989 | Namikoshi et al. | 424/409 |
| 5,069,935 | A | * | 12/1991 | Walters | 473/599 |
| 5,181,717 | A | * | 1/1993 | Donntag et al. | 473/605 |
| 5,310,178 | A | | 5/1994 | Walker et al. | |
| 5,536,304 | A | * | 7/1996 | Coppens et al. | 252/8.57 |
| 5,681,233 | A | | 10/1997 | Guenther et al. | |
| 5,820,488 | A | * | 10/1998 | Sullivan et al. | 473/374 |
| 5,836,827 | A | * | 11/1998 | Ogawa et al. | 473/594 |
| 5,931,752 | A | * | 8/1999 | Guenther et al. | 473/604 |
| 6,024,661 | A | | 2/2000 | Guenther et al. | |
| 6,123,632 | A | * | 9/2000 | Feeney et al. | 473/596 |

OTHER PUBLICATIONS

Wilson Solution Basketball Manufactured by Wilson Sporting Goods Company, Chicago, IL.
"Polyurethane Handbook", Edited by Dr. Gunter Oertel, 2nd Ed. 1994.

* cited by examiner

*Primary Examiner*—Steven Wong
(74) *Attorney, Agent, or Firm*—Timothy J. Martin; Michael R. Henson; Rebecca A. Gegick

(57) ABSTRACT

A panel that is used in forming the panel portions of recreational sport balls, and methods for the production thereof, are provided. The panels may be affixed to an inflatable bladder and include a base layer of polymeric material and a covering layer bonded thereto. The base layer may be bonded to a substrate layer of nonwoven cloth. The covering layer includes at least one conditioning agent that is either a water repellant agent to reduce water and sweat absorption, or an antistatic agent to repel dirt and dust, but may include both agents. The conditioning agent(s) may penetrate into the outer surface of the base layer to form the covering layer bonded thereto. Alternatively, the base layer may resist penetration by the conditioning agent(s) such that the covering layer is bonded to the surface of the base layer. The covering layer may further include an anti-bacterial agent.

22 Claims, 4 Drawing Sheets

SPORT BALL HAVING IMPROVED SURFACE AND METHOD FOR MANUFACTURE THEREOF

FIELD OF THE INVENTION

The present invention generally relates to athletic and recreational balls for use in sporting games and activities. More particularly, the present invention is directed to a sport ball, such as a basketball, having an improved surface, which provides greater durability, feel and control during play. More specifically, the present invention is directed to a basketball having panel portions formed from a flexible panel having anti-static and water repulsion characteristics. The present invention also is directed to such a flexible panel for use in manufacturing a sport ball, and methods for production thereof.

BACKGROUND OF THE INVENTION

The modern game of basketball began in 1891 when James Naismith hung two peach baskets from a gymnasium balcony in the Springfield, Mass. YMCA Training School, which is now Springfield College. The objective of the original game was for two teams to compete by tossing a soccer ball into a basket, thereby to score cumulative points. In 1894, the soccer ball used in the game was replaced with a slightly larger ball measuring 30 to 32 inches in circumference, and made of cowhide that had been glued to heavy canvas and then inflated.

Since that time, the game of basketball has become immensely popular world-wide, as both a professional sport watched by millions, and as a recreational sport played by persons of all races, genders and socioeconomic backgrounds. This success is partly attributable to the simple requirements of the game, which only requires a ball and a hoop. It can be played informally with one or more members on a team, and can be played on numerous types of playing surfaces, from polished wooden floors of an arena or gymnasium to schoolyard or playground concrete courts, asphalt driveways, and even dirt backyards.

The ball with which the game is played has evolved from the simple cowhide ball of 1894 to a leather-covered or polymeric composition-covered ball of about 29 to 30 inches in circumference and weighing between 18 and 22 ounces. In recent years, the surface of a basketball has been fashioned out of a polyurethane material that has been textured with a pebble texture to provide a better gripping surface for one's fingers on the ball. The pebble texture provides a pattern of depressions and projections which engage the pads of one's fingertips, thereby providing increased contact between the fingers and the ball.

The ability to deftly control a basketball is an extremely important aspect of the game. When shooting, a person generally holds a basketball by the fingertips, such that only a small surface area of the basketball is contacted. Further, it is desirable to provide a slight backspin to the ball when shooting, so as to more likely deflect the ball into the basket upon a bounce on the rim or backboard of the basketball hoop. A ball that has a slick or slippery surface, such as from water or sweat buildup, dirt or dust pickup, or wear on the surface is accordingly undesirable as it increases the chances that one's fingertips will slip on the ball surface and reduce feel and control thereof.

In addition to shooting, other aspects of the game of basketball require deft control of the ball. For example, dribbling and passing often require precise movements of the ball, wherein a slip can lead to a turnover of the ball to the opposing team. In particular, the bounce pass commonly used in the game often imparts a high degree of rotation and spin, which can cause such a pass to slip through the fingers of a receiving player and can often result in a turnover.

Accordingly, it is desirable that a basketball have a tacky outer surface that can increase grip and fingertip control in shooting and that can minimize the chances of a spinning ball slipping out of a player's hands during play, such that a player receiving a pass can immediately gain possession of the ball. It would be desirable, therefore, to have a ball in which water and sweat absorption, as well as dirt and dust pick up is minimized. Additionally, balls that retain moisture can become heavy and can undesirably store the germs and bacteria associated with sweat. Accordingly, it would further be desirable to have a ball that resists bacteria and fungus growth thereon. In addition, such characteristics would be desirable for balls used in other sports, such as football and the like, wherein control and grip of the ball by a player is of great importance.

Accordingly, it can be seen that there remains a need to provide a new and improved sport ball surface, such as for a basketball, football, or the like, as well as to provide methods for manufacture thereof. The present invention is directed to meeting these needs.

SUMMARY OF THE INVENTION

It is an object of the present invention to provide a new and improved ball for use in sporting games and activities.

It is another object to provide an improved basketball having a greater degree of durability, feel and control over conventional basketballs.

It is yet another object to provide a flexible panel for use in manufacturing a sport ball according to the present invention.

A still further object is to provide a flexible panel from which panel portions may be formed for use in manufacturing basketballs, footballs and the like.

Yet another object is to provide a method of producing a flexible panel for use in manufacturing a sport ball having an improved surface.

A still further object of the present invention is to provide a method of producing a sport ball having an improved surface.

According to the present invention, a flexible panel is provided, which is adapted for use as an outer covering for a ball of a selected size and configuration, wherein the flexible panel comprises a base layer and a covering layer. The base layer is formed of a polymeric material, and the covering layer is bonded to the base layer and includes at least one conditioning agent which may be a water repellant agent or an anti-static agent. Preferably, the covering layer includes both the water repellant agent and the anti-static agent, and may additionally include an anti-bacterial agent. The base layer preferably includes a polyurethane material, and may be bonded to a substrate layer, such as a nonwoven cloth commonly used in basketball manufacture. The preferred water repellant agent is either fluorine based or silicon based, and is more preferably a fluorinated acrylate. The preferred anti-static agent is a modified fatty salt. The preferred anti-bacterial agent is 2-n-octyl-4-isothiazolin-3-one.

The present invention is also directed to a method of producing a flexible panel that is adapted for use as an outer covering for a ball of a selected size and configuration. The method comprises the steps of mixing a polymer and at least one of a thickener, water, a surfactant, and a coloring agent with a first solvent to form a first mixture; coating a portion of a substrate layer with the first mixture to form a coated substrate; curing the first mixture to form a base layer bonded to the substrate layer; mixing at least one conditioning agent with a second solvent thereby to form a second mixture; contacting the base layer with the second mixture to form a treated panel; and curing the second mixture to form a covering layer bonded to the base layer. The step of curing the first mixture preferably includes dipping the coated substrate into a coagulation tank, which preferably includes a mixture of water and dimethylformamide, and the coated substrate may be thereafter washed with warm water. After curing, the coated substrate is preferably dried at a temperature of approximately 120° C. to 130° C. The base layer may be contacted with the second mixture by dipping the base layer into the second mixture for a selected interval of time, and the second mixture may be thereafter cured by drying the treated panel at a temperature of approximately 120° C. to 150° C. A texture, such as a pebble texture commonly used on basketballs, may be thereafter printed on a working surface of the covering layer.

The present invention is also directed to an improvement to a ball of a selected size and a selected configuration having an outer surface thereof. The improvement comprises a covering layer that is bonded to a portion of the outer surface, wherein the covering layer includes at least one conditioning agent. The covering layer preferably includes both the water repellant and anti-static agents in such a manner that the water repellant agent and the anti-static agent are cross-linked. The covering layer may further include an anti-bacterial agent.

The present invention is additionally directed to a ball of a selected size and configuration, wherein the ball comprises an inflatable bladder and a plurality of panel portions affixed to the bladder. Each of the panel portions includes a base layer formed of a polymeric material and a covering layer bonded to the base layer. The covering layer includes at least one conditioning agent, and preferably includes both the water repellant agent and anti-static agent, and may additionally include an anti-bacterial agent. The preferred inflatable bladder includes a plurality of ribs projecting radially outwardly from an outer surface of the bladder, wherein the ribs define a configuration of regions of the outer surface, each region bounded by selected ones of the ribs. The panel portions are affixed to the bladder within the configuration of regions such that peripheral margins of the panel portions confront the ribs. The base layer preferably includes a polyurethane material, and is preferably bonded to a substrate layer, such as a nonwoven cloth.

Finally, the present invention is directed to a method of producing a ball of a selected size and configuration. The method comprises the steps of providing a base layer formed of a polymeric material; bonding a covering layer to the base layer thereby to form a flexible panel; dividing the flexible panel into a plurality of panel portions; and affixing selected ones of the panel portions to an inflatable bladder. The covering layer includes at least one conditioning agent, and preferably includes both the water repellant agent and the anti-static agent. The step of bonding the covering layer to the base layer may be accomplished by contacting the base layer with a mixture comprising a solvent and the conditioning agent, and thereafter curing the mixture. The mixture may further include an anti-bacterial agent. The method may additionally include the step of printing a texture on a working surface of the covering layer. The step of affixing the panel portions to the bladder may be accomplished by use of an adhesive substance or by compression molding.

These and other objects of the present invention will become more readily appreciated and understood from a consideration of the following detailed description of the exemplary embodiments of the present invention when taken together with the accompanying drawings, in which:

BRIEF DESCRIPTION OF THE DRAWINGS

FIG. 1 is a perspective view of a flexible panel as known in the art for use in making basketballs, footballs and the like;

DETAILED DESCRIPTION OF THE EXEMPLARY EMBODIMENTS

The present invention is broadly directed to a new and useful surface for sport and recreational balls, such as basketballs, footballs and the like. The present invention is especially adapted for use with basketballs, wherein the improved feel and control of a basketball provided by the present invention is of great benefit to basketball players. In particular, the present invention is directed to the manufacture of a flexible panel that is used in forming the panel portions of a basketball's outer surface. Specifically, the present invention is directed to an outer covering layer that covers a portion of the outer surface of a basketball manufactured from the flexible panel. This covering layer provides dirt and water repulsion characteristics that are not found on conventional basketballs.

The water repulsion characteristics of the present invention minimize moisture and sweat absorption, such that a ball manufactured according to the present invention will not get significantly heavy from water absorption and will not become slick after a few uses, in contrast to conventional basketballs. Additionally, the water repulsion characteristics of the present invention minimize absorption of germs and bacteria that are found in sweat. The present invention may alternatively include an anti-bacterial agent, such as one having anti-bacterial and anti-fungicidal properties, to fight such germs and bacteria. The dirt and dust repulsion characteristics of the present invention prolong the tack and grip of the surface of a ball manufactured according to the present invention. It should be understood that, while the present invention is primarily directed toward the manufacture of basketballs, the present invention is contemplated for use in the manufacture of numerous types of sport and recreational-type balls as well. Therefore, while the description of the invention herein is given in the context of a basketball, it should be understood that the claims of the present invention are directed to all types of sport and recreational balls.

Figure 1:
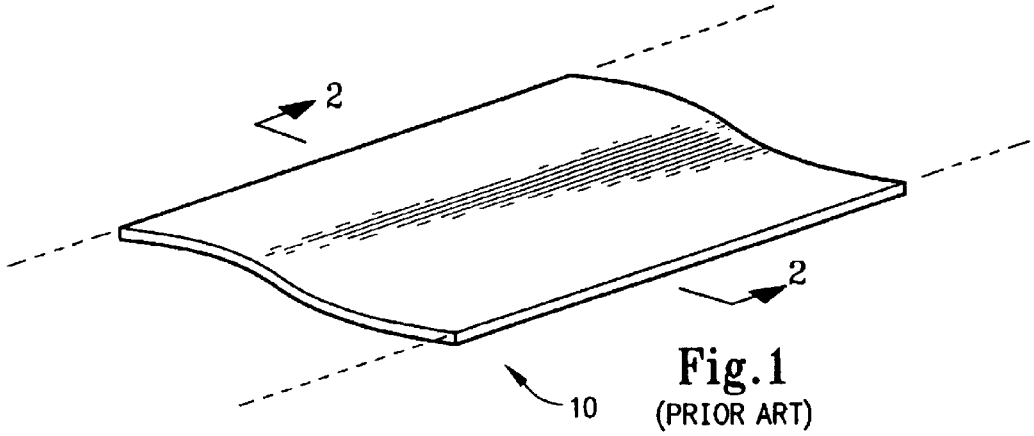
Fig.1 (PRIOR ART)
Figure 2:
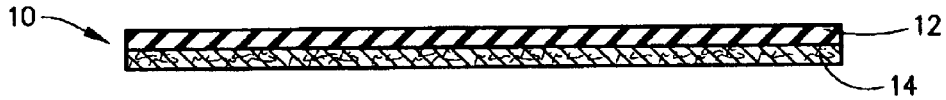
Fig.2 (PRIOR ART)
FIG. 2 is a cross-sectional view of the flexible panel of FIG. 1.

Turning to FIG. 1, outer surface portions of a basketball are conventionally manufactured from a sheet of a flexible panel 10, which is generally produced in three foot by thirty foot (3'×30') pieces, or pieces with similar manufacturing dimensions. This flexible panel 10 is commonly referred to in the art as a polyurethane (PU) leather. As shown in FIG. 2, flexible panel 10 generally consists of a base layer 12 bonded to a substrate layer 14. Base layer 12 generally consists of a polyurethane foam and substrate layer 14 is generally a nonwoven cloth, as known in the art.

Figure 3:
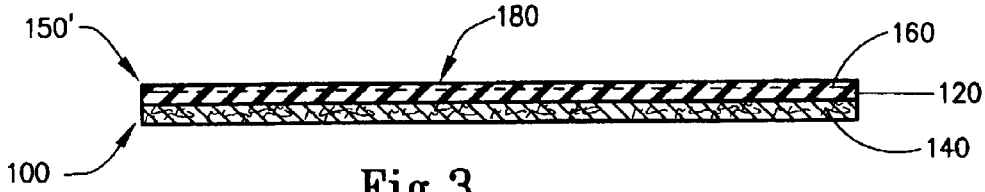
FIG. 3 is a cross-sectional view of a flexible panel according to the present invention.

As shown in FIG. 3, the present invention provides a flexible panel 100 useful in forming outer surface portions of a basketball or other sport or recreational ball. Flexible panel 100 comprises a base layer 120 bonded to a substrate layer 140 and additionally includes a covering layer 160 that includes at least one conditioning agent. The conditioning agent is believed to penetrate into an outer surface region 150 of base layer 120, thereby to form covering layer 160 bonded to base layer 120. It is believed that in such a case, the amount of covering layer 160 permeating into a selected depth of base layer 120, as measured from working surface 180, would be inversely proportional to the magnitude of that depth. As such, covering layer 160 might be characterized as a diffusion layer, to the extent understood in the art. Alternatively, as shown in FIG. 3*a*, base layer 120' of flexible panel 100' may be formed of a material that resists penetration by the conditioning agent, such that covering layer 160' is bonded to a surface 150' of base layer 120'.

Figure 3A:
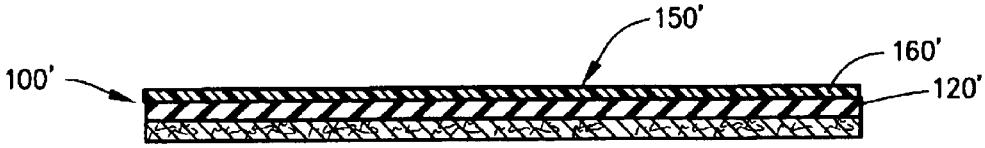
FIG. 3*a* is a cross-sectional view of an alternative configuration of the flexible panel according to the present invention.

It should be understood that reference herein to a covering layer that is bonded to a base layer contemplates both the configurations of FIGS. 3 and 3*a*, as well as other configurations to the extent understood by the ordinarily skilled artisan. It should also be appreciated that specific reference herein to base layer 120 and covering layer 160 of FIG. 3 contemplates base layer 120' and covering layer 160', respectively, of FIG. 3*a*, and vice versa.

The base layer 120 is preferably a polyurethane material and the substrate layer 140 is preferably a nonwoven cloth, as commonly used in the art of basketball manufacture. Base layer 120 may be formed as a mixture of a polymer, preferably polyurethane; a solvent, preferably dimethylformamide (DMF); a thickener, preferably cellulose; water; an anionic surfactant; and a polyurethane color paste. The mixture is coated on substrate layer 140 and cured, either wholly or partially, thereby to form base layer 120 bonded to substrate layer 140.

The composition of covering layer 160 preferably comprises both a water-repellant agent and an anti-static agent. Covering layer 160 reduces dirt pick up and reduces water and sweat absorption on the surface of a ball manufactured with flexible panel 100 according to the present invention. In particular, the amount of dirt adhering to a ball manufactured with flexible panel 100 is reduced by the presence of the anti-static agent in covering layer 160, while the amount of water and sweat absorbed is reduced by the presence of the water-repellant agent in covering layer 160. Covering layer 160 may additionally include an anti-bacterial agent operative to resist bacterial and fungicidal growth thereon. When covering layer 160 has the configuration as shown in FIG. 3, working surface 180 retains the desired tacky feel of the polyurethane base layer 120.

Covering layer 160 is preferably formed by contacting base layer 120 with a mixture of the water-repellant agent, the anti-static agent, and water. Where desired, the anti-bacterial agent may be additionally added to the mixture. The mixture may then be cured, thereby to form covering layer 160, and working surface 180 may thereafter be textured as known in the art, such as with a pebble roller press, thereby to provide an improved gripping surface for working surface 180. It should be understood that, where base layer 120 was only partially cured, both covering layer 160 and base layer 120 may be wholly cured after contacting base layer 120 with the mixture of water-repellant agent, anti-static agent, and water.

An exemplary embodiment of the chemical composition of base layer 120 prior to curing is illustrated by Table I, as follows:

TABLE I

| Component | Chemical Substance | Weight | Weight % |
|---|---|---|---|
| Polymer | Polyurethane, 8006 HV | 100 g | 49.3–54.6% |
| Solvent | DMF | 60–80 g | 32.8–39.4% |
| Thickener | Cellulose, Technocel 40 | 5 g | 2.5–2.7% |
| Water | N/A | 5 g | 2.5–2.7% |
| Anionic surfactant | S700A | 5 g | 2.5–2.7% |
| Color paste | Various | 8 g | 3.9–4.4% |

Table I shows the composition by weight of an exemplary embodiment of the base layer 120 of the invention prior to curing. Preferably, the components of Table I are mixed, and the mixture is coated on substrate layer 140, after which the mixture is cured such as by a coagulation process as known in the art, thereby to form base layer 120 bonded to substrate layer 140.

The preferred polyurethane polymer is preferably the 8006HV polyurethane product produced by Lidye Chemical Company, Ltd., located in Taipei, Taiwan. The preferred characteristics of the polyurethane polymer are a viscosity of 10,000 to 20,000 centipoise, a maximum 100% modulus of approximately 35 kg/cm$^2$, and a minimum tensile strength of approximately 900 kg/cm$^2$. It should be understood that the 8006HV polyurethane ingredient may be substituted by numerous polyurethane products available in the market, to the extent understood by the ordinarily skilled person.

The preferred solvent is preferably dimethylformamide (DMF), which is manufactured and produced by numerous suppliers, and is readily available to those skilled in the art.

The preferred thickener is preferably Technocel 40, which is a cellulose product produced by Cellulose Filler Factory Corporation, located in Chestertown, Md. The preferred cellulose thickener preferably has at least 97% of the cellulose particles of a size of 32 um or smaller, as determined by screen analysis (Alpine Air Draught Sieve), for example.

The preferred anionic surfactant is preferably S700A, produced by Jiuh Yi Chemical Industrial Co., Ltd., located in Taipei, Taiwan. Alternatively, a nonionic surfactant may be substituted for the anionic surfactant ingredient. A suitable nonionic surfactant is SP80, produced by Jiuh Yi Chemical Industrial Co., Ltd., located in Taipei, Taiwan. It should be understood that other suitable wetting agents may be substituted for the anionic surfactant ingredient, as well.

The preferred color paste is any one of a variety of PU color pastes commonly used in the art, as would be apparent to the ordinarily skilled artisan.

A weight percent variation of approximately five percent (i.e. +/−5% weight percent error) for each component shown in Table I is acceptable. Additionally, it should be understood that the characteristics of base layer 120 may be adjusted as desired by modifying the ingredients of Table I, to the extent understood by the ordinarily skilled person. For example, base layer 120 may be manufactured without one or more of the ingredients of Table I, or in varying amounts of these ingredients, thereby to adjust the flatness, thickness, softness, etc. characteristics of base layer 120.

An exemplary embodiment of the chemical composition of the covering layer 160 prior to curing is illustrated by Table II, as follows:

TABLE II

| Component | Chemical Substance | Weight | Weight % |
|---|---|---|---|
| Water Repellant Agent | Fluorinated Acrylate | 8 g | 7.3% |
| Anti-Static Agent | Modified Fatty Salt | 5 g | 4.5% |
| Water | N/A | 97 g | 88.2% |

The preferred water repellant agent is preferably X-8, which is a fluorinated acrylate product produced by Yoshimura Ltd., located in Osaka, Japan. It should be understood that numerous other water repellant agents on the market may be substituted for the water repellant agent ingredient in Table II, such as fluorine and silicon based water repellants as known in the art. Accordingly, the claims of the present invention contemplate the use of various water repellant agents as understood in the art, including but not limited to the fluorinated acrylate X-8 product.

The preferred anti-static agent is preferably TC-918, which is a modified fatty salt produced by Tai Gi Co., Ltd., located in Lin Ko Taipei, Taiwan. In particular, the TC-918 product is a cationic, highly surface active agent which effectively binds hydration to surfaces at low relative humidity, and which specifically provides antistatic protection below 20% relative humidity. Additionally, the TC-918 product is physically compatible with anionic systems, is soluble in a wide range of solvent polarities and is stable over a wide pH range. Again, it should be understood that the present invention contemplates the substitution of other anti-static agents on the market for the anti-static agent ingredient in Table II, such that it should be appreciated that the claims of the present invention contemplate the use of various anti-static agents as understood in the art, including but not limited to the TC-918 product.

Additionally, an anti-bacterial agent may be added to the ingredients of Table II. In such a case, it is preferred that the anti-bacterial agent is 2-n-octyl-4-isothiazolin-3-one, which is available to ordinarily skilled persons in the art from various suppliers. The 2-n-octyl-4-isothiazolin-3-one agent is known to prevent the growth of three (3) types of bacteria and thirteen (13) types of fungi, and is believed to be nontoxic to humans. Because the 2-n-octyl-4-isothiazolin-3-one product can be very expensive, the anti-bacterial agent may be added to the solution of the ingredients of Table II in an amount of approximately 0.1% by weight. It should be understood that the present invention contemplates the substitution of other anti-bacterial agents on the market for the 2-n-octyl-4-isothiazolin-3-one product, such that it should be appreciated that the claims of the present invention contemplate the use of various anti-bacterial agents as understood in the art. It should be further understood that references herein to an anti-bacterial agent contemplate agents having anti-bacterial properties, anti-fungicidal properties, or both.

Preferably, the components of Table II are mixed and the mixture is applied to the surface of base layer 120, after which the mixture is cured, such as by heated drying, to form covering layer 160 bonded to base layer 120. It should be understood that the present invention contemplates variations in the amount and type of the ingredients of Table II. For example, various other water repellant agents and anti-static agents may be substituted for the ingredients of Table II, as discussed above, and the relative amounts of these ingredients may be adjusted as desired. Furthermore, it should be understood that other solvents may be substituted, as appropriate, for the water ingredient of Table II, to the extent understood by the ordinarily skilled artisan. Additionally, it should be understood that the present invention contemplates a covering layer 160 including only one of the anti-static and water repellant agent ingredients.

It should further be understood that the present invention contemplates a flexible panel having a single base layer 120 in the absence of a substrate layer 140, wherein the covering layer 160 is bonded to one surface or surface region of the base layer 120. It should further be understood that base layer 120 may in such a case be a polymeric, rubber, leather, foam or other material suitable for use in manufacturing sport and recreational balls. Additionally, it should be understood that the present invention contemplates a flexible panel having a plurality of substrate layers 140 or base layers 120, wherein the covering layer 160 is bonded to an outer surface or surface region of the combined substrate and base layers.

Figure 4A:
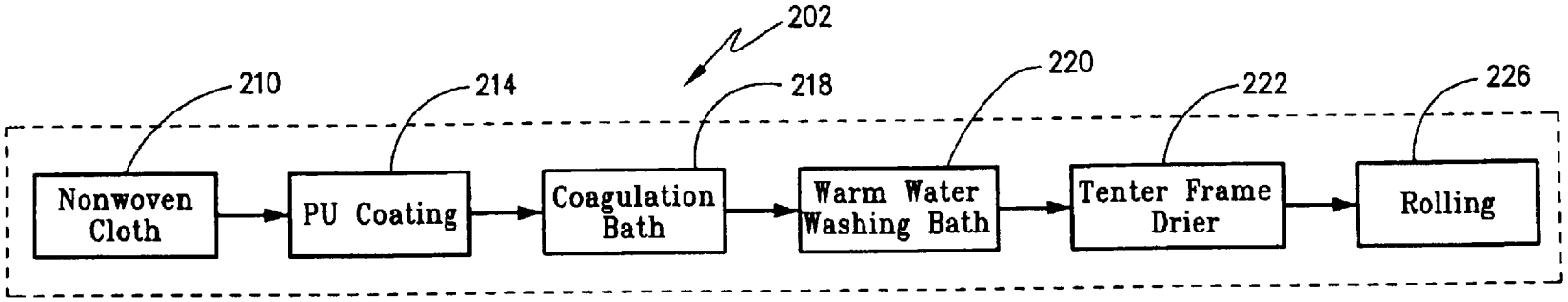
FIG. 4*a* is a flowchart of a polyurethane leather process step according to the method of the present invention.
Figure 4B:
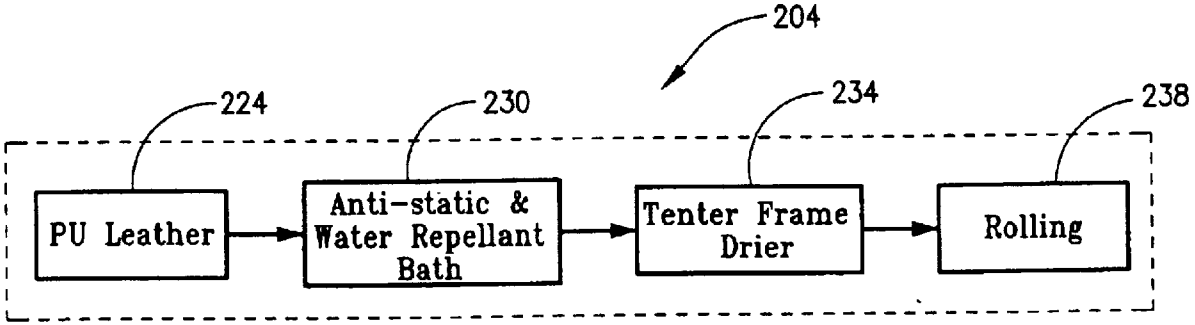
FIG. 4*b* is a flowchart of a covering layer treatment step according to the method of the present invention.
Figure 4C:
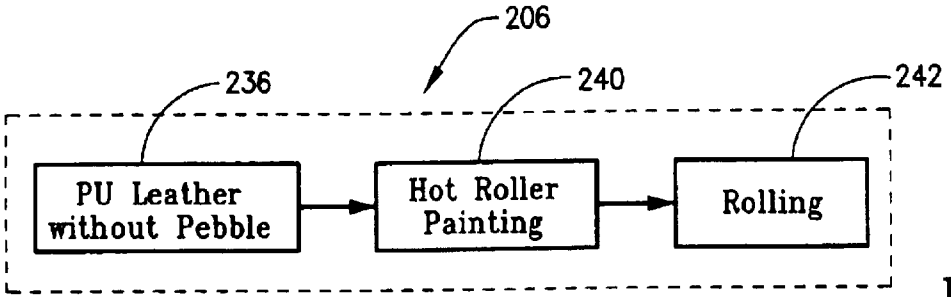
FIG. 4*c* is a flowchart of an optional pebble-printing step according to the present invention.

The present invention also relates to a process for producing a flexible panel for use in manufacturing sport and recreational balls, such as basketballs, footballs and the like. As shown in FIGS. 4*a*, 4*b* and 4*c*, the preferred process includes a PU leather process step 202, a covering layer treatment step 204 and a pebble printing step 206. In the preferred method, the components of Table I, above, are first mixed together to form mixture 200. The solvent, preferably DMF, is added in an amount sufficient to adjust the viscosity of mixture 200 to a range of preferably between 4000 and 5000 centipoise.

Figure 5A:
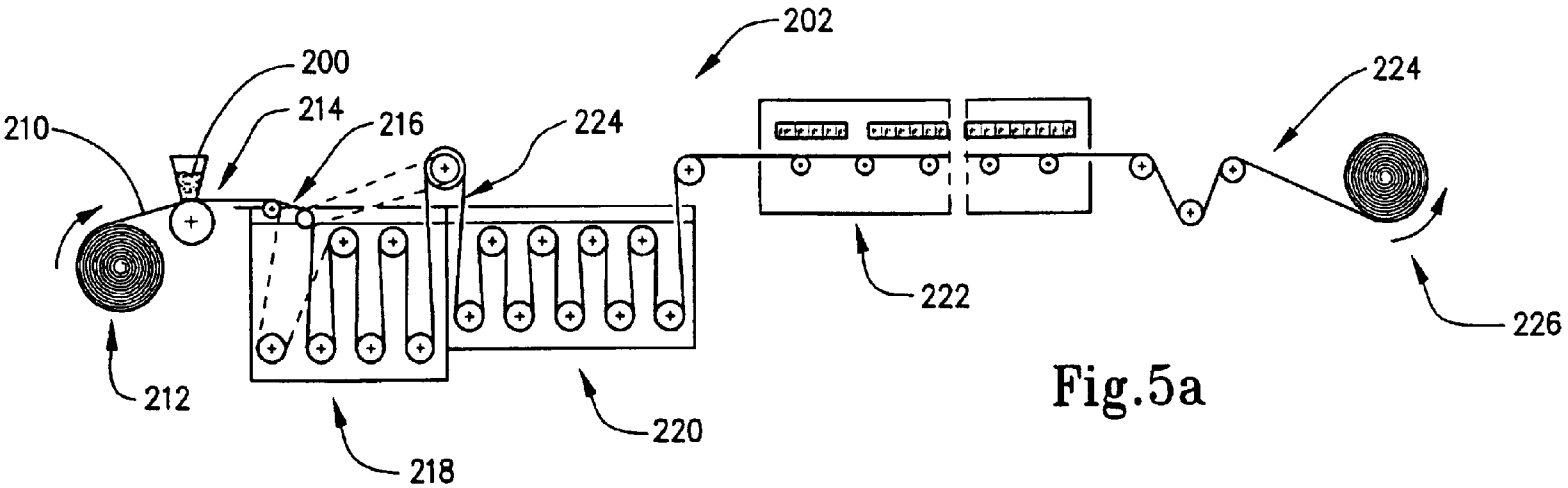
FIG. 5*a* is a diagrammatic view of the polyurethane leather process step of FIG. 4*a;*

In the PU leather process step 202, as shown in FIGS. 4*a* and 5*a*, a substrate layer, here nonwoven cloth 210, is provided such as by roll 212. Nonwoven cloth 210 is of a type which preferably contains 25% to 35% water weight, as known in the art. A PU coating 214 of mixture 200 is applied to a surface of nonwoven cloth 210. Mixture 200 is preferably coated on the nonwoven cloth 210 in an amount of approximately 320 g/m$^2$. It should be understood that the thickness or weight of base layer 120 may be adjusted by modifying the amount of the mixture 200 that is coated on the nonwoven cloth 210.

The coated cloth 216 is then dipped into a coagulation tank 218 for approximately thirty (30) minutes, as known in the art. This step cures mixture 200, thereby to produce a PU leather 224 having base layer 120 and substrate layer 140 bonded thereto (as shown in FIG. 3). The solution in the coagulation tank 218 preferably consists of five percent (5%) DMF and ninety-five percent (95%) water by weight. The PU leather 224 is then washed by 50° to 60° C. warm water for twenty (20) minutes in one or more washing baths 220. PU leather 224 may then be dried in a tenter oven 222 at 120° to 130° C. for ten (10) minutes, thereby to remove any excess water remaining in PU leather 224. PU leather 224 may then be rolled into roll 226.

Figure 5B:
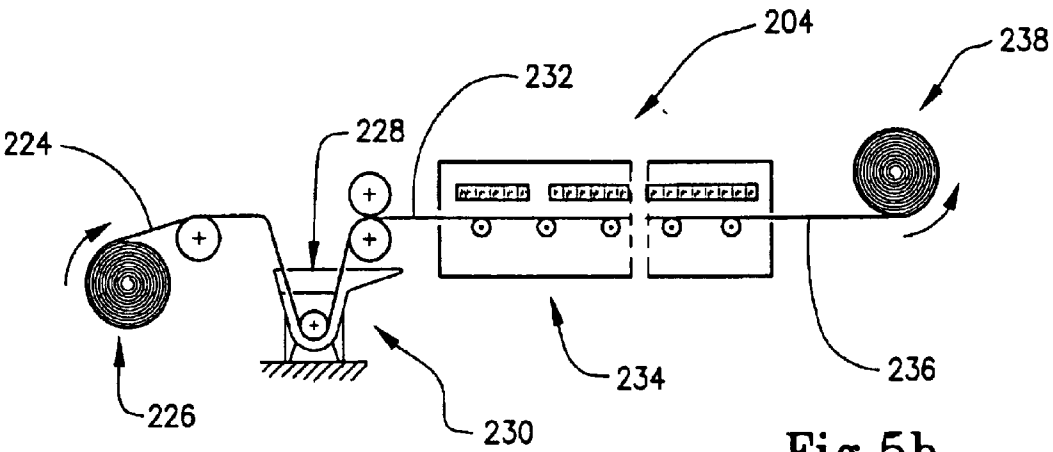
FIG. 5*b* is a diagrammatic view of the covering layer treatment step of FIG. 4*b;*

In the covering layer treatment step 204, as shown in FIGS. 4*b* and 5*b*, a mixture 228 is prepared of 8 g water repellant agent, 5 g anti-static agent and 97 g of water. It should be understood that an anti-bacterial agent may be incorporated into mixture 228 as well, as discussed above. PU leather 224 provided by roll 226 is then preferably dipped into the mixture 228, such as in an anti-static and water-repellant bath 230. It should be understood that the mixture 228 of water repellant agent, anti-static agent and water may be applied directly on the surface of base layer 120 of PU leather 224 by other means as known in the art, such as spraying or coating the mixture on base layer 120 by a treatment roller. It has been found, however, that such surface treatment of mixture 228 on base layer 120 provides poorer results than dipping PU leather 224 into mixture 228 for an interval of time.

This finding suggests that, with respect to flexible panels having a polyurethane base layer 120, the configuration illustrated in FIG. 3 may be more accurate than that of FIG. 3*a*, such that the invention contemplates penetration of mixture 224 into an outer surface region 150 of base layer 120, thereby to form covering layer 160 as shown in FIG. 3. Accordingly, it should be understood that reference herein to coating, contacting or bonding the covering layer to the base layer contemplates formation of a separate coating of the covering layer on the base layer, or formation of a region of the base layer where one or both of the anti-static and water repellant agents penetrate into the outer surface region of the base layer to form the covering layer, as well as other configurations to the extent understood by the ordinarily skilled artisan.

The treated flexible panel 232 is then dried in a tenter oven 234, preferably at 150° C., although a range of 120° C. to 150° C. is acceptable, which allows the water repellant and anti-static agents to crosslink and express their functions. This step forms treated PU leather flexible panel 236, which has covering layer 160, a composition comprising the water repellant agent and the anti-static agent, that is bonded to base layer 120 (as shown in FIG. 3). Treated PU leather 236 may then be rolled into roll 238.

It should also be appreciated that the present invention contemplates variations to the method, such as by combining PU leather process step 202 and covering layer treatment step 204 into a single step. For example, it is contemplated that the anti-static agent and water repellant agent might be added to coagulation tank 218, such that base layer 120 and covering layer 160 are formed simultaneously upon curing. Other variations are contemplated to the extent understood by the ordinarily skilled artisan.

In the optional pebble printing step 206, as shown in FIG. 4*c*, working surface 180 (as shown in FIG. 3) of treated PU leather flexible panel 236 is preferably textured by printing a pebble texture, such as that commonly used in making basketballs, through the use of hot roller printing 240, which may be a 150° C. pebble roller press, as known in the art. It should also be understood that surface 180 may be textured by the use of print plates and by other methods as known in the art. The pebble printing step provides an improved gripping surface for working surface 180, which provides better contact between a person's fingers and a basketball during play, thereby improving control and feel of the basketball. The pebbled PU leather may then be rolled 242, thereby to provide a roll of flexible panel 100 for use in producing basketballs, footballs, and the like. It should be appreciated that the present invention contemplates alternatively performing pebble printing step 206 prior to performing covering layer treatment step 204, such that the covering layer is formed on a textured surface or surface region of the PU leather.

Figure 7:
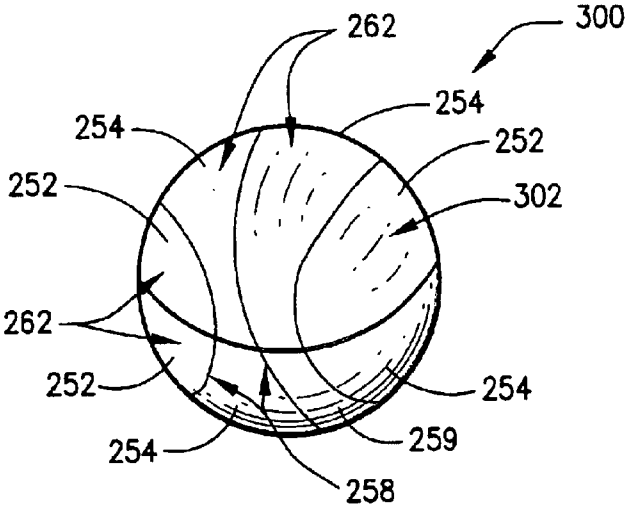
FIG. 7 is a basketball manufactured with the cut-out panel portions of FIG. 6.
Figure 6:
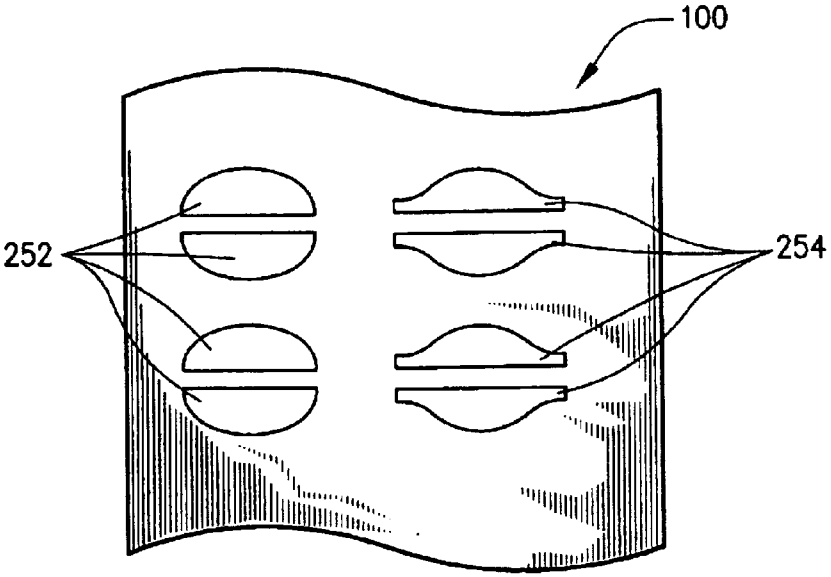
FIG. 6 is a top plan view of a flexible panel according to the present invention showing exemplary cut-out panel portions for a basketball.
Figure 8:
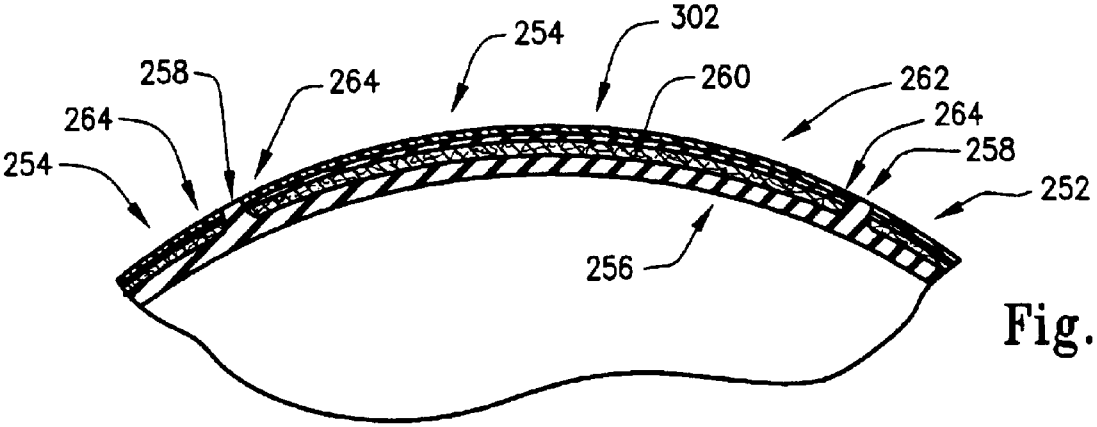
FIG. 8 is partial view in cross section of the basketball of FIG. 7.

The present invention is also directed to sport and recreational balls having portions of an outer surface formed from the flexible panel 100 of the present invention. In the preferred embodiment, flexible panel 100 is used in the manufacture of basketball panel portions, as shown in FIGS. 6, 7, and 8, although it should be understood that other types of balls, such as footballs and the like, may be manufactured from flexible panel 100. Here, panel portions 252 and 254 are formed by cutting them from flexible panel 100, such as shown in FIG. 6. Flexible panel 100 may be divided into panel portions 252 and 254 by any method and in any configuration as known in the art. The panel portions 252 and 254 may then be printed with one or more selected designs as known in the art. Thereafter, selected ones of panel portions 252 and 254 may be affixed to a bladder, such as an inflatable spherical bladder commonly used in the manufacture of basketballs, thereby to form basketball 300 as shown in FIG. 7. Preferably, as shown in FIGS. 7 and 8, inflatable bladder 256 includes a plurality of ribs 258, which project radially outwardly from an outer surface 260 of bladder 256. Ribs 258 define a configuration of regions 262, where each region 262 is bounded by selected ones of ribs 258. Panel portions 252 and 254 are affixed to bladder 256 within regions 262 such that peripheral margins 264 of panel portions 252 and 254 confront ribs 258.

Panel portions 252 and 254 may be affixed by any means known in the art, such as by the use of adhesives and/or compression molding. The resulting basketball product 300 has a surface 302 that is tacky and durable, and which repels water, dirt and dust, providing substantial benefit to basketball players in feel and control of the ball.

It should also be understood that the present invention generally contemplates balls which have a covering layer bonded to a portion of an outer surface or surface region thereof, wherein the covering layer includes at least one conditioning agent selected from a group consisting of an anti-static agent and a water repellant agent. For example, the present invention contemplates various sport and recreational type balls, such as solid foam or rubber balls, layered balls, inflatable balls, and the like of varying sizes, shapes and configurations, wherein such balls include an anti-static agent and/or a water repellant agent disposed on at least a portion of the outer surface of the balls.

To test the water retention, tackiness and durability of the resulting basketball products 300, several tests were performed. In particular, as shown in Table III below, the water absorption of a ball manufactured from the flexible panel of the present invention, labeled "CL-04" in Table III, was tested against (1) a ball labeled "CL-03" in Table III, which was manufactured without the anti-static agent and water repellant agent, but was otherwise similar to CL-04; (2) a ball produced by Wilson Sporting Goods Co. of Chicago, Ill., identified as "Wilson Solution" in Table III; and (3) a ball produced by Spalding Sports Worldwide of Chicopee, Mass., designated "Spalding TF-1000" in Table III.

TABLE III

| Ball | Item | Water Absorption 1st | 2nd | 3rd | Average |
|---|---|---|---|---|---|
| CL-03 | D | 616.37 | 616.18 | 616.33 | 616.29 |
| | W2 | 621.35 | 621.02 | 621.55 | 621.31 |
| | W2-D | 4.98 | 4.84 | 5.22 | 5.02 |
| | W15 | 617.60 | 617.21 | 618.02 | 617.61 |
| | DR | 0.29 | 0.29 | 0.27 | 0.28 |
| CL-04 | D | 598.92 | 598.96 | 599.23 | 599.04 |
| | W2 | 603.84 | 603.48 | 603.84 | 603.72 |
| | W2-D | 4.92 | 4.52 | 4.61 | 4.68 |
| | W15 | 599.93 | 599.49 | 600.37 | 599.92 |
| | DR | 0.30 | 0.31 | 0.27 | 0.29 |
| Wilson Solution | D | 590.97 | 590.82 | 591.05 | 590.95 |
| | W2 | 603.48 | 602.95 | 603.37 | 603.27 |
| | W2-D | 12.51 | 12.13 | 12.32 | 12.32 |
| | W15 | 598.47 | 598.48 | 598.85 | 598.60 |
| | DR | 0.38 | 0.34 | 0.35 | 0.35 |
| Spalding TF-1000 | D | 582.50 | 582.78 | 582.85 | 582.71 |
| | W2 | 587.61 | 589.79 | 588.24 | 588.55 |
| | W2-D | 5.11 | 7.01 | 5.39 | 5.84 |
| | W15 | 587.05 | 588.67 | 587.40 | 587.71 |
| | DR | 0.04 | 0.09 | 0.06 | 0.06 |

D = Dry ball weight (g)
W2 = Wet ball weight after 2 minutes (g)
W2-D = the weight difference between W2 and D (g): Water absorption
W15 = Wet ball weight after 15 minutes (g)
DR = Drying Rate (g/min.)

In Table III, D is the dry ball weight in grams, W2 is the wet ball weight after two (2) minutes in grams, W2-D is the weight difference between W2 and D in grams, which indicates the water absorption of the ball, W15 is the wet ball weight after fifteen (15) minutes in grams and DR is the calculated drying rate in grams per minute.

As apparent from Table III, a basketball manufactured with the flexible panel according to the present invention has a substantially lower average water absorption than conventional basketballs. Additionally, the ball manufactured according to the present invention had the second highest drying rate of the four balls tested.

Additionally, as shown in Table IV, a test was performed to measure the tackiness and durability of a ball manufactured according to the present invention. Here, flour was used as a medium to represent dirt that might adhere to a basketball, thereby to provide an approximation of the propensity of a ball manufactured according to the present invention to pick up dirt and dust.

TABLE IV

| Ball | Test | Wt. Before Test | Wt. With Flour | Flour Wt. | Wt. After Shooting Test | Wt. Lost |
|---|---|---|---|---|---|---|
| CL-04 | 1st | 602.4 g | 657.8 g | 55.4 g | 601.9 g | 0.5 g |
| | 2nd | 601.9 g | 659.6 g | 57.7 g | 601.5 g | 0.4 g |
| Wilson | 1st | 591.5 g | 646.2 g | 54.7 g | 591.1 g | 0.4 g |
| Solution | 2nd | 591.1 g | 643.8 g | 52.7 g | 590.6 g | 0.5 g |
| Spalding | 1st | 572.3 g | 624.9 g | 52.6 g | 572.2 g | 0.1 g |
| TF-1000 | 2nd | 572.2 g | 622.8 g | 50.6 g | 572.1 g | 0.1 g |

Here, the ball labeled CL-04, corresponding to a ball manufactured according to the present invention, was tested against the Wilson Solution and the Spalding TF-1000 type balls, which were used in the test for water absorption, above. The test was conducted at 22° C. with humidity of seventy-five percent (75%). The ball pressure was eight (8) pounds. All three balls were weighed prior to testing, and then were each placed into a plastic bag containing one hundred grams (100 g) of flour and mixed well. Balls were then placed into a shooting machine, which performed a shooting test five hundred (500) times. Balls were subsequently re-weighed. A second test on each ball was also performed under the same conditions.

As shown in Table IV, the CL-04 version picked up more flour than the other balls against which it was tested, indicating that the CL-04 version exhibited increased tackiness. Additionally, the CL-04 did not display significant degradation, as shown by the column labeled "Wt. Lost" in Table IV.

As apparent from the foregoing, the present invention provides a new and useful sport ball having superior characteristics, especially for use in the game of basketball. The present invention also provides a new and useful flexible panel for use in manufacturing sport balls, and a method for production thereof.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. In an inflatable ball of a selected size and a selected configuration and having an outer surface thereof, the improvement comprising a covering layer bonded to a portion of said outer surface, wherein said covering layer includes an anti-static conditioning agent.

2. A ball according to claim 1 wherein said covering layer includes a water repellant agent.

3. A ball according to claim 2 wherein said water repellant agent and said anti-static agent are cross-linked.

4. A ball according to claim 2 wherein said water-repellant agent is selected from a group consisting of fluorine based and silicon based water repellants.

5. A ball according to claim 1 wherein said anti-static agent is a modified fatty salt.

6. A ball according to claim 1 wherein said covering layer further includes an anti-bacterial agent.

7. A ball according to claim 6 wherein said anti-bacterial agent is 2-n-octyl-4-isothiazolin-3-one.

8. A ball according to claim 1 wherein said outer surface is defined by a base layer and wherein said covering layer is defined by a diffusion layer of said conditioning agent diffused into an outer surface region of said base layer.

9. A ball of a selected size and configuration, said ball comprising an inflatable bladder and a plurality of panel portions affixed thereto, wherein each of said panel portions includes a base layer formed of a polymeric material and a covering layer bonded to said base layer, said covering layer including both a water repellant agent and an anti-static agent that do not penetrate into the entire depth of said base layer.

10. A ball according to claim 9 wherein said inflatable bladder includes a plurality of ribs projecting radially outwardly from an outer surface thereof thereby to define a configuration of regions of said outer surface wherein each region is bounded by selected ones of said ribs, and wherein said panel portions are affixed to said bladder within said configuration of regions such that peripheral margins of said panel portions confront said ribs.

11. A ball according to claim 9 wherein said base layer includes a polyurethane material.

12. A ball according to claim 9 wherein said base layer is bonded to a substrate layer.

13. A ball according to claim 12 wherein said substrate layer is formed of a nonwoven cloth.

14. A ball according to claim 9 wherein said covering layer further includes an anti-bacterial agent.

15. In a ball of a selected size and a selected configuration and having an outer surface thereof, the improvement comprising a covering layer bonded to a portion of said outer surface, wherein said covering layer includes both a water repellant conditioning agent and an anti-static conditioning agent.

16. A ball according to claim 15 wherein said water repellant agent and said anti-static agent are cross-linked.

17. A ball according to claim 15 wherein said water-repellant agent is selected from a group consisting of fluorine based and silicon based water repellants.

18. A ball according to claim 15 wherein said anti-static agent is a modified fatty salt.

19. A ball according to claim 15 wherein said covering layer further includes an anti-bacterial agent.

20. A ball according to claim 19 wherein said anti-bacterial agent is 2-n-octyl-4-isothiazolin-3-one.

21. A ball of a selected size and configuration, said ball comprising an inflatable bladder and a plurality of panel portions affixed thereto, wherein each of said panel portions includes a base layer formed of a polymeric material and a covering layer bonded to said base layer, said covering layer including both a water repellant conditioning agent and an anti-static conditioning agent.

22. A ball according to claim 21 wherein said covering layer further includes an anti-bacterial agent.

* * * * *